United States Patent [19]

Harper

[11] 4,133,054

[45] Jan. 9, 1979

[54] LOWER BODY GARMENT AND METHOD

[75] Inventor: Oris E. Harper, Asheboro, N.C.

[73] Assignee: Rampon Products, Incorporated, Asheboro, N.C.

[21] Appl. No.: 815,945

[22] Filed: Jul. 15, 1977

[51] Int. Cl.[2] ..... A41B 9/04

[52] U.S. Cl. ..... 2/407; 2/409

[58] Field of Search ..... 2/406, 407, 409, 402, 2/401

[56] References Cited

U.S. PATENT DOCUMENTS

| | | | |
|---|---|---|---|
| 2,320,408 | 6/1943 | Clark | 2/401 X |
| 2,687,525 | 8/1954 | Rutledge | 2/407 |
| 3,678,515 | 7/1972 | Wehrmann | 2/409 |

FOREIGN PATENT DOCUMENTS

| | | | |
|---|---|---|---|
| 1214554 | 11/1959 | France | 2/409 |
| 1328276 | 8/1973 | United Kingdom | 2/406 |

*Primary Examiner*—H. Hampton Hunter

*Attorney, Agent, or Firm*—Bell, Seltzer, Park & Gibson

[57] ABSTRACT

The garment may be in the form of a panty, panty girdle, panty hose or the like and includes a panty portion formed of single piece front and rear panels with seams connecting opposite sides and a single seam extending transversely across the crotch area. The single piece front and rear panels are formed by transversely cutting seamless tubular blanks at an angle so that one side of the tube is substantially longer than the opposite side and then longitudinally slitting the tubular lengths of fabric along the shorter sides so that each panel includes opposite cut sides and inwardly and downwardly inclined cut edges. The lower medial portions of the cut edges of the body panels are joined together to form a crotch area and the opposite cut sides of the body panels are joined by side seams to form a pair of leg openings and a single waist opening. The panty hose includes legs with angularly cut upper ends which are joined to the panty portion with the longer portions of the legs being joined to the upper portions of the leg openings.

6 Claims, 11 Drawing Figures

LOWER BODY GARMENT AND METHOD

This invention relates generally to lower body garments and methods of forming the same and more particularly to panty, panty girdle, and panty hose type garments which are formed of seamless tubular knit blanks by a simple cutting and seaming operation.

It is the usual practice to form panty hose type garments by knitting a pair of tubular seamless hosiery blanks, longitudinally slitting the upper ends and joining together the corresponding slit edges of the hosiery blanks to form a U-shaped seam extending from the rear to the front of the waist opening and through the crotch area. The two legs of this type of panty hose are directly joined together and in many cases this does not provide sufficient width to the panty and crotch area. In an attempt to overcome this difficulty, it has been proposed to provide a diamond-shaped crotch patch in the crotch area. However, the use of the crotch patch does not completely eliminate the problem since the areas of the hosiery blanks adjacent the crotch area are still directly connected to each other. Also, the seam extending down the middle portion of the front and rear of the panty and through the crotch area is unsightly and may be a source of discomfort to the wearer.

With the foregoing in mind, it is an object of the present invention to provide a lower body garment including a panty portion which is formed of single piece front and rear panels with seams extending along opposite sides thereof and with a single transversely extending seam joining the front and rear panels in the crotch area so that the leg openings are separated in the crotch area and thereby provides a better fit. This construction also eliminates the seams extending down the middle portions of the front and rear of the panty and through the crotch area.

In accordance with the present invention, the single piece front and rear panels are formed of seamless knit tubular blanks which are transversely cut at one end at an angle to provide tubular lengths of fabric with one side being substantially longer than the opposite side. The shorter sides of a pair of the tubular lengths of fabric are longitudinally slit to form front and rear body panels with parallel cut opposite side edges and inwardly and downwardly inclined lower cut edges. The medial portions of the inwardly and downwardly inclined lower cut edges of the body panels are joined together to form the crotch area and the opposite cut side edges of the body panels are joined to form a pair of leg openings and a single waist opening.

If desired, a crotch patch may be sewn in position on the inside of the crotch area of the panty. Also, a crotch patch may be connected between the body panels and the crotch patch may be made of moisture absorbent material and it may be of an open mesh construction to provide ventilation in the crotch area.

The garment may include relatively short legs to form a panty girdle type garment or the garment may include long legs for covering the legs and feet of the wearer to form a panty hose type garment. In either case, the legs are provided with angularly disposed upper ends which are seamed to the leg openings of the panty with the longer portions of the upper ends of the legs being joined to the panty portion at the sides seams and with the shorter portions of the legs being joined to the leg openings in the crotch area of the panty portion. The medial portions of the inwardly and downwardly inclined lower cut edges are connected by the transverse seam extending across the crotch area so that the legs are separated a suitable distance, depending upon the length of the seam extending transversely in the crotch area.

The blanks for forming the garments of the present invention may be knit in a conventional manner on a circular hosiery knitting machine and may be economically finished to form the garments by a single cutting and sewing operation. The waist opening of the garment may be provided with a suitable elastic band and the panty and leg portions may be knit of the same or different types of yarn to provide light stretch or firm support.

Other objects and advantages will appear as the description proceeds when taken in connection with the accompanying drawings, in which FIG. 1 is a side elevational view of a seamless hosiery blank of the type used in forming one leg and one panel of the panty portion of a panty hose;

Figure 1:
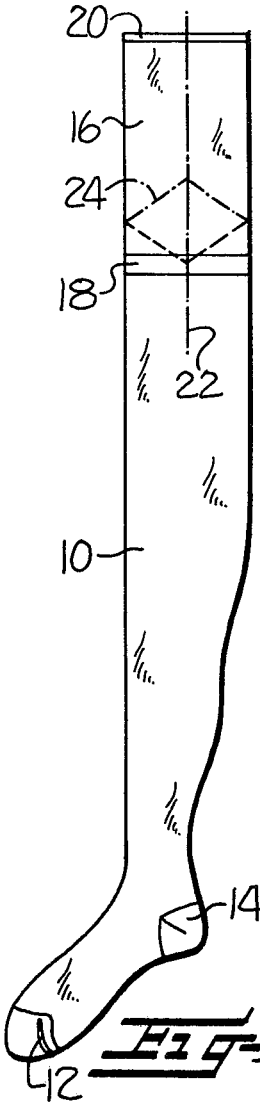
Figure 2:
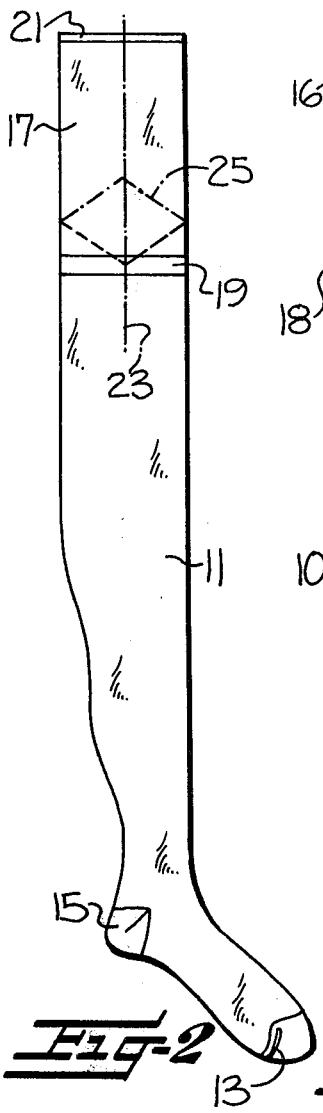
FIG. 2 is an elevational view of a secondary hosiery blank used in forming the other leg and the other panel of the panty portion of the panty hose.

The method of forming the panty hose type garment illustrated in FIGS. 1-6 includes knitting a pair of seamless tubular hosiery blanks 10, 11 of sufficient length to reach from the toes to the waist of the wearer, of the type illustrated in FIGS. 1 and 2. The hoisery blanks are then closed at the toe end portions, as indicated at 12, 13, and include either reciprocatorily knit or boarded heel pockets 14, 15. The upper end portions of the hosiery blanks 10, 11 are preferably knit of a heavier yarn in the panty areas, indicated at 16 and 17, and these heavier knit panty areas are separated from the sheerer knit leg portions by run-resistant knit bands 18, 19. The upper ends of the hosiery blanks 10, 11 are preferably provided with narrow turned welts 20, 21. The hosiery blanks are boarded to impart to them the shape illustrated in FIGS. 1 and 2 by the conventional method of placing the blanks on hosiery boarding forms and heat setting the shape in the hosiery blanks. Both of the blanks shown in FIGS. 1 and 2 are identical and two blanks are illustrated in order to make it clear that two identical blanks must be transversely cut at opposed angles adjacent their upper ends to form a panty hose.

As the boarded panty hose blanks are laid flat, they include front and rear fold lines and it is necessary to refold the upper end portions before the angular cuts are made. The upper end portions are refolded along the dash-dot lines 22, 23 of FIGS. 1 and 2 so that the front and rear fold lines are repositioned to lie flat against each other to create new fold lines, as indicated in FIGS. 3 and 4, with the front fold lines of both hosiery blanks toward the observer and with the toes of the hosiery blanks facing forwardly.

Figure 3:
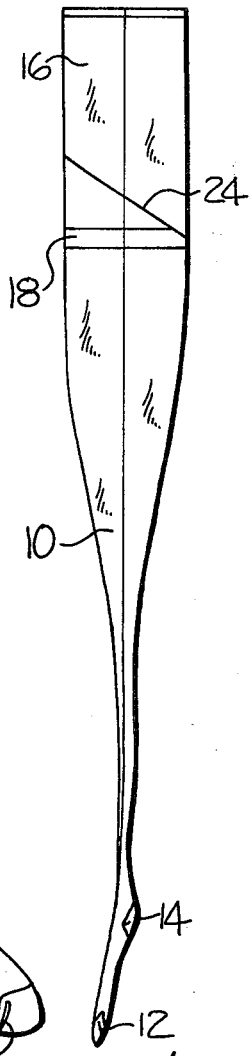
FIG. 3 illustrates the angular transverse cutting of the flattened upper end of the seamless hosiery blank shown in FIG. 1.
Figure 4:
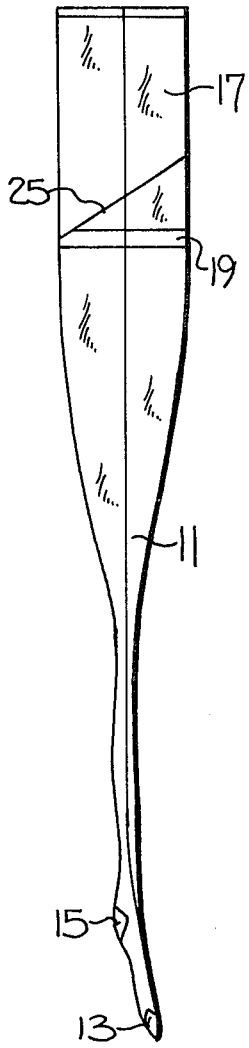
FIG. 4 illustrates the angular transverse cutting of the flattened upper end of the seamless hosiery blank shown in FIG. 2.
Figure 5:
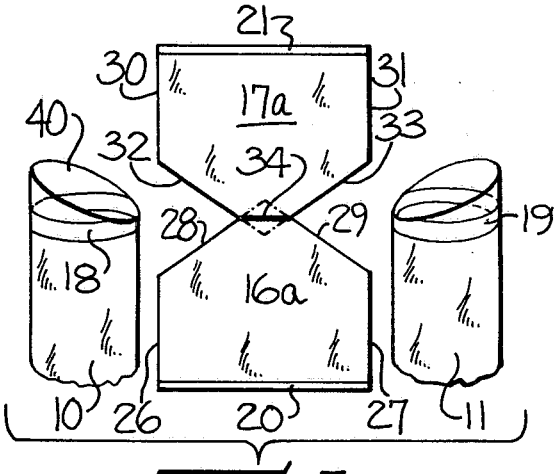
FIG. 5 illustrates the single piece front and rear panels transversely connected in the crotch area and with the angularly disposed upper end portions of the hosiery legs positioned adjacent opposite sides thereof.

The upper end portion of each of the hosiery blanks is then transversely cut at an angle of approximately 30° and in opposite downwardly inclined directions, as indicated by the cut lines 24 and 25 in FIGS. 3 and 4. The lower ends of the angular transverse cuts preferably extend into the respective run-resistant bands 18, 19 of the hosiery blanks 10, 11. The panty portions 16, 17 are then longitudinally slit along the shorter fold lines to provide a pair of identical body panels 16*a*, 17*a* (FIG. 5). The single piece front panel 16*a* is provided with parallel cut opposite side edges 26, 27 and inwardly and downwardly inclined cut edges 28, 29 which extend downwardy to a point. The rear panel 17*a* is also provided with corresponding parallel cut opposite sides edges 30, 31 and inwardly and downwardly inclined cut edges 32, 33 which also join at a point.

Figure 6:
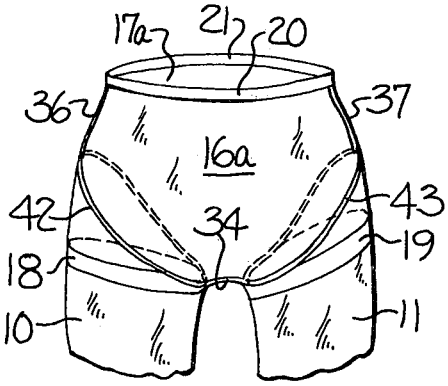
FIG. 6 is a perspective view illustrating the manner in which the legs are connected to the leg openings of the panty portion in the formation of a panty hose or panty girdle type garment.

The panels 16*a*, 17*a* are then positioned in overlying relationship and are joined together at the lower medial portions of the cut edges 28, 29 and 32, 33 with an overedge seam, as indicated at 34 while the pointed ends of the cut edges, indicated in dotted lines in FIG. 5, are cut away to provide a transversely extending crotch seam 34 connecting the front and rear panels 16*a*, 17*a*. The parallel cut opposite side edges 26, 30 and 27, 31 are joined together along corresponding side seams 36, 37 (FIG. 6) to form the panty portion of the garment and provide a pair of leg openings and a single waist opening defined by the turned welts 20, 21. The angularly cut upper ends of the hosiery blanks 10, 11, indicated at 40, 41 in FIG. 5, are then joined to the leg openings, with the longer portions thereof being joined to the upper portions of the leg openings and with the shorter portions being joined to the lower portions of the leg openings and at opposite ends of the crotch seam 34, by means of corresponding seams 42, 43 (FIG. 6).

Thus, the panty hose type garment formed in accordance with the present invention includes single piece front and rear panels 16*a*, 17*a* with the upper turned welt edges 20, 21 forming a waist opening. The parallel cut opposite sides of the panels 16*a*, 17*a* are connected together by vertical side seams 36, 37 and leg openings are formed by the inclined cut edges of the front and rear panels 16*a*, 17*a*. The transversely extending crotch seam 34 connects the front and rear panels 16*a*, 17*a* in the crotch area and the seams 42, 43 join the angularly disposed upper ends of the hosiery legs of the blanks 10, 11 to the leg openings of the panty hose portion, with the longer portions of the upper ends of the hosiery legs being joined to the panty portion at the side seams 36, 37 and with the shorter portions of the upper ends of the hosiery legs being joined to the leg openings at the opposite ends of the crotch seam 34. Thus, the crotch seam 13 separates the legs from each other (FIG. 6) and provides the desired amount of width across the panty of the garment. If desired, an elastic tape or waist band, not shown, may be sewn to the narrow turned welts 20, 21 of the panty hose to surround the waist opening.

Figure 7:
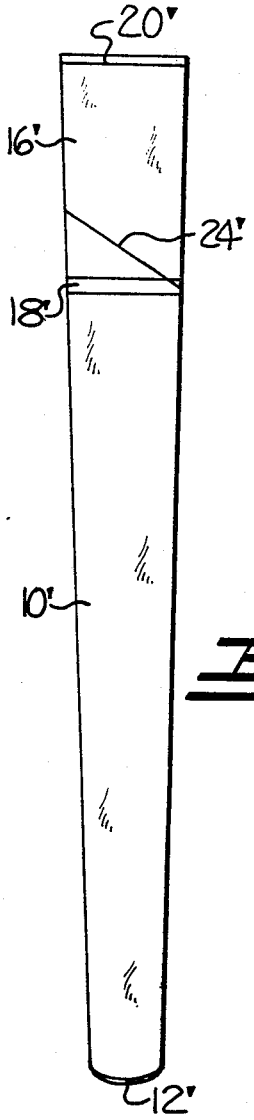
FIG. 7 is a side elevational view of a flattened "tube" type of seamless hosiery blank which may be used in forming a panty hose in accordance with the present invention.

A pair of "tube" type hosiery blanks, of the type illustrated in FIG. 7, may also be utilized in forming a panty hose type garment. This "tube" type hosiery blank, indicated at 10', is knit without a reciprocated heel and toe and is closed at the lower toe end, as by a seam 12'. The hosiery blank is knit of sufficient length to extend from the toe to the waist of the wearer and includes a turned welt 20' at its upper end. The upper panty portion 16' is preferably knit of a heavier denier yarn than the leg portion and is separated therefrom by a run-resistant band 18'. To form a panty hose type garment from this "tube" type of hosiery blank, it is merely necessary to transversely cut the flattened upper end portions of each of a pair of the hosiery blanks at an angle of approximately 30°, as indicated at 24'.

Two of the cut and flattened panty portions 16' are then longitudinally slit along the folds on the shorter sides to provide a pair of identical body panels with parallel cut opposite sides and inwardly and downwardly inclined cut edges. The lower medial portions of the cut edges of the body panels are then joined by a crotch seam, in the same manner as indicated in FIG. 5, and the parallel cut opposite side edges of the body panels are joined by seams, such as the seams 36 and 37 in FIG. 6, to complete the panty portion with a single waist opening and a pair of leg openings. The upper angularly cut ends of the hosiery blanks are then joined to the leg openings with seams, such as the seams 42 and 43 in FIG. 6, and with the longer portions being joined to the upper portions of the leg openings and the shorter portions being joined in the crotch area to complete the panty hose.

Figure 8:
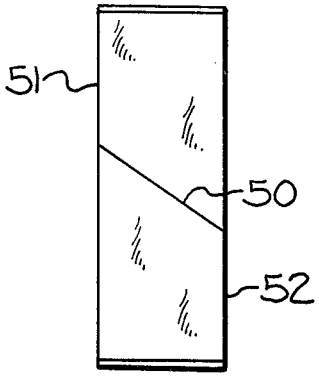
FIG. 8 is a flattened side elevational view of a straight tubular blank which may be used in forming a panty type garment in accordance with the present invention.
Figure 9:
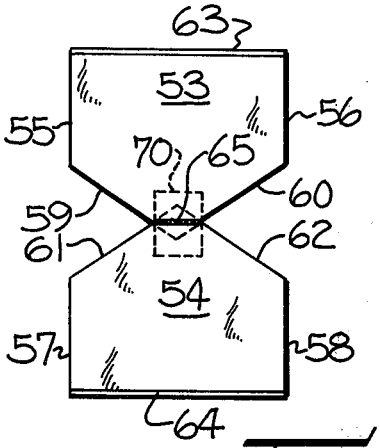
FIG. 9 is a view illustrating the manner in which the front and rear panels are joined together by a transverse crotch seam in a further step in the formation of a panty type garment.
Figure 10:
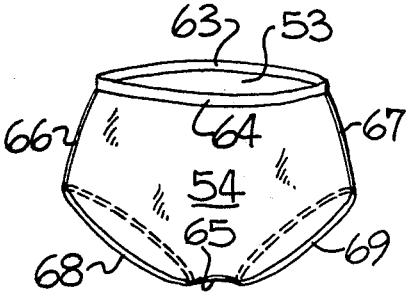
FIG. 10 is a perspective view of a finished panty type garment formed in accordance with the present invention.

A panty type of garment may be formed from a single seamless knit tubular blank of the type illustrated in FIG. 8. Also, a panty type of garment may be formed from a pair of seamless knit tubular blanks, each of which is of sufficient length to reach from the crotch to the waist of the wearer. When forming a panty garment of a single seamless tubular blank of the type illustrated in FIG. 8, it is merely necessary to make a transverse angular cut of approximately 30° across the medial portion of the flattened tubular blank, as indicated at 50. The shorter sides of the tubular blanks are then longitudinally slit along the fold lines 51, 52 to provide a pair of identical body panels 53, 54 (FIG. 9). The respective body panels 53, 54 include parallel cut opposite side edges 55, 56 and 57, 58 and inwardly and downwardly inclined cut eges 59, 60 and 61, 62. The upper ends of the body panels 53, 54 may be provided with turned welts 63, 64.

The lower portions of the inclined cut edges of th body panels are joined together by a transversely extending crotch seam 65. The panels 53, 54 may be positioned in overlying relationship and the overedge seam 65 is formed while a portion of each of the lower ends of the cut edges of the body panels is cut away to form a relatively wide crotch area. To complete the panty, the cut opposite side edges 55, 57 are joined together by a side seam 66 and the cut opposite side edges 56, 58 are joined by a side seam 67 to form a single waist opening, provided by the turned welts 63, 64 on the upper edges of the panels, and a pair of leg openings. The leg openings may be finished in any suitable manner, such as by overedging the same with an elastic tape, as indicated at 68 and 69. If desired, an elastic band or tape may be secured to the turned welts 63, 64 to provide an elastic waist band.

If desired, the inner portion of the crotch area of the panty may be provided with a crotch patch, as indicated by the dotted rectangle 70 in FIG. 9, which may be of any desired shape and type of material. The crotch patch 70 can be sewn in position over the seam 65 and opposite ends may extend over adjacent areas of the body panels 53, 54. It is preferred that the crotch patch 70 be formed of moisture absorbent material to aid in the comfort of the wearer.

Figure 11:
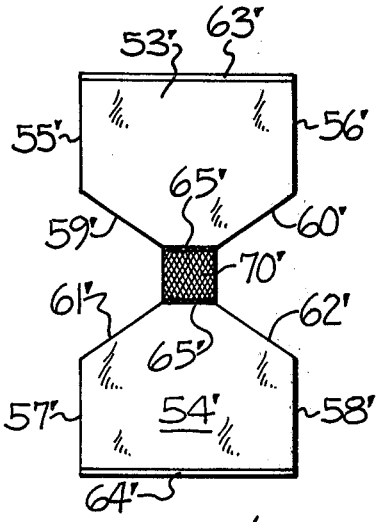
FIG. 11 is a view similar to FIG. 9 but showing a crotch patch being used to join the front and rear panels together.

The panty may be provided with a crotch patch of the type illustrated at 70' in FIG. 11. This crotch patch 70' has opposite ends connected to the lower portions of the inwardly and downwardly inclined lower cut edges 59', 60' and 61', 62' of the respective body panels 53', 54', as by seams 65'. The crotch patch 70' may be formed of moisture absorbent material and/or it may be of an open mesh construction to provide ventilation in the crotch area of the panty. The body panels illustrated in FIG. 11 are also provided with cut opposite side edges 55', 56' and 57', 58' as well as turned welts 63' and 64'. The cut opposite side edges of the panels 53', 54' are joined together by side seams to form a single waist opening and a pair of leg openings. The leg openings may be finished by overedging with an elastic tape or the upper ends of legs may be joined to the leg openings.

Thus, the lower body garment of the present invention includes a panty portion which is formed of single piece rear and front panels joined together along opposite sides by vertical seams and joined together by a transverse crotch seam so that the leg openings are separated. Suitable legs with angularly disposed upper ends may be joined to the leg openings to form a panty girdle type of garment with relatively short legs, or panty hose, tights, or leotard type garments with relatively short legs, or panty hose, tights, or leotard type garments may be formed by attaching long legs which cover the legs and feet of the wearer. In either case, the legs are separated in the crotch area and the vertical seams are provided at opposite sides of the panty and do not extend down the middle of the front and rear panels and through the crotch area, as is the usual practice. The garment of the present invention is adaptable to fit various size wearers and may be formed in a simple and economical manner.

In the drawings and specification there has been set forth preferred embodiments of the invention, and although specific terms are employed, they are used in a generic and descriptive sense only and not for purposes of limitation, the scope of the invention being defined in the claims.

That which is claimed is:

1. A panty hose type garment for covering the lower trunk and legs and feet of the wearer and formed from a pair of knit seamless blanks, said garment comprising (a) a panty portion including a single piece front panel formed from the upper end of one of the said seamless blanks, and a single piece rear panel formed from the upper end of the other of said seamless blanks, (b) each of said panels including an upper selvage edge with parallel cut opposite sides, and inclined cut edges extending inwardly and downwardly from said cut opposite sides, (c) means joining the lowermost portions of the inclined cut edges of said front and rear panels to form a crotch area in said panty portion, (d) seam means joining corresponding cut opposite sides of said front and rear panels to provide a pair of leg openings and a single waist opening, (e) a pair of seamless hosiery legs with feet at the lower ends and angularly disposed upper ends formed when said front and rear panels are cut from said seamless blanks so they they correspond with said inclined cut edges of said front and rear panels, and (f) seam means joining the angularly disposed upper ends of said hosiery legs to the leg openings of said panty portion with the longer portions of the upper ends of said hosiery legs being joined to said panty portion at the seam means joining opposite sides of said front and rear panels and with the shorter portions of the upper ends of said hosiery legs being joined to the leg openings at the crotch area of said panty portion.

2. A panty hose type garment according to claim 1 including a crotch patch positioned on the inside of the crotch area of said panty portion and extending over adjacent areas of said front and rear panels.

3. A panty hose type garment according to claim 1 wherein said means joining the lowermost portions of the inclined cut edges of said front and rear panels includes a crotch patch positioned between said front and rear panels, and seam means connecting corresponding ends of said crotch patch to the lowermost portions of the inclined cut edges of said front and rear panels.

4. A lower body garment covering at least the lower trunk and upper portions of the legs of the wearer and formed from a pair of knit seamless blanks, said garment comprising (a) a panty portion including a single piece front panel formed from the upper end of one of said seamless blanks, and a single piece rear panel formed from the upper end of the other of said seamless blanks, (b) each of said panels including an upper selvage edge with parallel cut opposite sides, and inclined cut edges inwardly and downwardly from said cut opposite sides, (c) means joining the lowermost portions of the inclined cut edges of said front and rear panels to form a crotch area in said panty portion, (d) seam means joining corresponding cut opposite sides of said front and rear panels to provide a pair of leg openings and a single waist opening, (e) a pair of seamless legs including angularly disposed upper ends formed when said front and rear panels are cut from said seamless blanks so that they correspond with said inclined cut edges of said front and rear panels, and (f) seam means joining the angularly disposed upper ends of said seamless legs to the leg openings of said panty portion with the longer portions of the upper ends of said legs being joined to said panty portion at the seam means joining opposite sides of said front and rear panels with the shorter portions of the upper ends of said legs being joined to the leg openings at the crotch area of said panty portion.

5. A lower body garment according to claim 4 including a crotch patch positioned on the inside of the crotch area of said panty portion and extending over adjacent areas of said front and rear panels.

6. A lower body garment according to claim 4 wherein said means joining the lowermost portions of the inclined cut edges of said front and rear panels includes a crotch patch positioned between said front and rear panels, and seam means connecting corresponding ends of said crotch patch to the lowermost portions of the inclined cut edges of said front and rear panels.

* * * * *